United States Patent [19]

Esper et al.

[11] 4,128,420

[45] Dec. 5, 1978

[54] HIGH-STRENGTH IRON-MOLYBDENUM-NICKEL-PHOSPHORUS CONTAINING SINTERED ALLOY

[75] Inventors: Friedrich J. Esper, Leonberg; Robert Zeller, Stuttgart, both of Germany

[73] Assignee: Robert Bosch GmbH, Stuttgart, Germany

[21] Appl. No.: 778,679

[22] Filed: Mar. 17, 1977

[30] Foreign Application Priority Data

Mar. 27, 1976 [DE] Fed. Rep. of Germany ..... 2613255

[51] Int. Cl.[2] ..... C22C 33/02; C22C 38/08; C22C 38/12

[52] U.S. Cl. ..... 75/230; 75/123 D; 75/123 K; 75/123 J; 75/246

[58] Field of Search ..... 75/230, 246, 123 D, 75/123 K, 123 J

[56] References Cited

U.S. PATENT DOCUMENTS

| | | | |
|---|---|---|---|
| 2,226,520 | 12/1940 | Lenel | 75/230 |
| 2,291,734 | 8/1942 | Lenel | 75/246 X |
| 2,478,841 | 8/1949 | Schmidt | 75/123 K |
| 2,707,680 | 5/1955 | Succop | 75/123 K |
| 2,923,622 | 2/1960 | Shafer | 75/246 X |
| 3,067,032 | 12/1962 | Reed et al. | 75/246 X |
| 3,719,474 | 3/1973 | Bieber et al. | 75/123 K |
| 3,977,838 | 8/1976 | Hashimoto et al. | 75/123 J X |

FOREIGN PATENT DOCUMENTS

| | | | |
|---|---|---|---|
| 271993 | 8/1970 | U.S.S.R. | 75/123 K |

OTHER PUBLICATIONS

Esper, F. J., Chem. Abs., vol. 85, (1976), #164278c, (Z. Werkstofftech. 1976:7(7), 256–261).

*Primary Examiner*—Richard E. Schafer
*Attorney, Agent, or Firm*—Flynn & Frishauf

[57] ABSTRACT

To provide an alloy having high strength, toughness, and which is highly resistant to impact loading, the alloy has the following composition (all percentages by weight): 2–4.5 Mo, more than 2.5 to less than 3.5% Ni, more than 0.3 to less than 0.6% P, the rest iron; preferably, 3% Mo, 3% Ni, 0.45% P and the rest iron are used.

4 Claims, No Drawings

HIGH-STRENGTH IRON-MOLYBDENUM-NICKEL-PHOSPHORUS CONTAINING SINTERED ALLOY

The present invention relates to a high strength iron-molybdenum-nickel sintered alloy which further includes phosphorus.

Iron-molybdenum-nickel sintered alloys have been proposed with addition of chromium and/or manganese, and/or copper. Increased strength is obtained by heat treatment or thermal refinement of these alloys. Manufacture of such materials is expensive, however, and frequently leads to distortion of the parts.

Alloys based on iron-molybdenum-nickel with addition of phosphorus have also been proposed. These alloys have sufficient strength, but do not have sufficient toughness. Addition of chromium to such alloys decreases shrinkage or contraction upon sintering, somewhat increases the strength, but further decreases the toughness thereof.

Sintered steels of high strength, and particularly of high toughness resp. impact resistance, are still needed in order to permit wider application thereof.

It is an object of the present invention to provide an iron-molybdenum-nickel sintered alloy with a phosphorus additive, which has the improved toughness resp. impact resistance and which has the following characteristics:

Tensile strength $\sigma_B \geqq 600$ N/mm$^2$
ratio of yield to tensile strength $\sigma_S/\sigma_B \geqq 0.65$
elongation at rupture $\Delta \geqq 7\%$ and
toughness $a_b \geqq 50$ Joule/cm$^2$, wherein N represents Newtons, and 1 kg(force) = 9.807 N.

The alloy, additionally, should be capable of being made in as few manufacturing steps as possible in spite of the high required strength.

SUBJECT MATTER OF THE PRESENT INVENTION

Briefly, the alloy has the following composition (all percentages by weight): Molybdenum: 2 to 4.5%; nickel: more than 2.5 to less than 3.5%; phosphorus: more than 0.3 to less than 0.6%; the remainder iron. Preferably, the alloy consists of 3% molybdenum, 3% nickel, 0.45% phosphorus, the remainder iron.

Manufacture of the sintered alloy: Pure molybdenum and nickel powder are mixed with addition of a lubricant, such as zinc stearate, and with an iron powder which already contains the required quantity of phosphorus. The powders are then compressed at a pressure of 600 to 700 MN/m$^2$ and sintered for 45 to 90 minutes at a temperature of about 1250° C. under a protective atmosphere, such as $H_2$ or forming gas. Special precautions which have usually to be undertaken during sintering with carbon-containing alloys are not necessary. The respective values of strength of the alloys in accordance with the present invention are determined by the ASTM methods by making sintered test bars from the powders. Single sintering technology is sufficient in order to obtain the required characteristics regarding strength properties.

EXAMPLES

The composition, conditions of manufacture, and the obtained density, as well as the strength of materials will be given in the following examples, together with comparative examples going beyond preferred ranges in accordance with the present invention;

EXAMPLES:

| | | |
|---|---|---|
| 1. | Composition: | 2% Mo; 3% Ni, 0.45% P remainder Fe |
| | Pressing: | 650 MN/m$^2$ |
| | Sintering: | 60 min at 1250° C |
| | Density: | 7.45 g/cm$^3$ |
| | Characteristics of strength | |
| | $\sigma_B = 600$ N/mm$^2$ | $\sigma_S/\sigma_B = 0.79$ |
| | $\delta = 7\%$ | $a_b = 60$ J/cm$^2$ |
| 2. | Composition: | 3% Mo; 3% Ni; 0.45% P remainder Fe |
| | Pressing: | 600 MN/m$^2$ |
| | Sintering: | 60 min at 1250° C |
| | Density: | 7.45 g/cm$^3$ |
| | Characteristics of strength: | |
| | $\sigma_B = 615$ N/mm$^2$ | $\sigma_S/\sigma_B = 0.8$ |
| | $\delta = 9.5\%$ | $a_b = 75$ J/cm$^2$ |
| 3. | Composition: | 4.5% Mo; 3% Ni; 0.45% P remainder Fe |
| | Pressing: | 600 MN/m$^2$ |
| | Sintering: | 60 min at 1250° C |
| | Density: | 7.5 g/cm$^3$ |
| | Characteristics of strength: | |
| | $\sigma_B = 650$ N/mm$^2$ | $\sigma_S\sigma_B = 0.82$ |
| | $\delta = 9\%$ | $a_b = 75$ J/cm$^2$ |
| 4. | Composition: | 2.5% Mo; 2.5% Ni; 0.45% P remainder Fe |
| | Pressing: | 600 MN/m$^2$ |
| | Sintering: | 60 min at 1250° C |
| | Density: | 7.45 g/cm$^3$ |
| | Characteristics of strength | |
| | $\sigma_B = 540$ N/mm$^2$ | $\sigma_S/\sigma_B = 0.72$ |
| | $\delta = 14\%$ | $a_b = 80$ J/cm$^2$ |
| 5. | Composition: | 3% Mo; 3.5% Ni; 0.45% P remainder Fe |
| | Pressing: | 600 MN/m$^2$ |
| | Sintering: | 60 min at 1250° C |
| | Density: | 7.4 g/cm$^3$ |
| | Characteristics of strength: | |
| | $\sigma_B = 680$ N/mm$^2$ | $\sigma_S/\sigma_B = 0.82$ |
| | $\delta = 6.5\%$ | $a_b = 45$ J/cm$^2$ |

Examples 1 to 3 are within the claimed limits above given. The strength properties of the materials meet minimum requirements. The content of nickel of the composition in accordance with Example 4 is just below the required range; that of Example 5 is just above the required range. It can be seen that the resulting characteristics with respect to strength properties no longer meet the required value. In Example 4, the tensile strength is below the required value; in Example 5, the elongation at rupture as well as the toughness are below the required values.

In actual use, the alloy in accordance with Example 3 has been found to be particularly desirable.

The iron-molybdenum-nickel sintered alloy containing phosphorus, provides high tensile strength, while simultaneously resulting in high toughness with respect to impact loading. Elements made from the sintered alloys can, therefore, be used for highly loaded structural components which are required more and more by modern technology. The characteristics regarding strength properties can be obtained by single sintering without additional heat treatment, so that the manufacture of shaped items is simple and economical, resulting in decreased costs therefore. These sintered alloys of iron, nickel, molybdenum, and phosphorus, in their strength properties, even approach the expensive hot forged powder metallurgical materials.

The invention also includes sintered alloys which are a preferred embodiment of the invention containing about 3% nickel, between about 2% and 4.5% molybdenum, about 0.45% phosphorus, and the balance essentially iron. In all the alloys the iron which is the balance of the alloy may contain the usual minor impurities without affecting the special characteristics of the alloys of the present invention.

We claim:

1. A high strength sintered alloy consisting essentially of between about (i) 2% and 4.5% by weight molybdenum, (ii) more than 2.5% and less than 3.5% nickel, (iii) more than 0.3% and less than 0.6% phosphorus, and the balance iron, and having a tensile strength $\sigma_B \geqq 600$ N/mm$^2$; ratio of yield to tensile strength $\sigma_S/\sigma_B \geqq 0.65$; elongation at rupture $\delta \geqq 7\%$; and toughness $a_b \geqq 50$ Joule/cm$^2$.

2. The alloy of claim 1 containing about 3% nickel.

3. The alloy of claim 2 containing about 3% molybdenum, and 0.45% phosphorus.

4. The alloy of claim 1 containing about 3% nickel and about 0.45% phosphorous.

* * * * *